US009107264B2

(12) United States Patent
Yu et al.

(10) Patent No.: US 9,107,264 B2
(45) Date of Patent: Aug. 11, 2015

(54) ELECTRONIC CONTROL GEARS FOR LED LIGHT ENGINE AND APPLICATION THEREOF

(71) Applicant: Groups Tech Co., Ltd., Taipei (TW)

(72) Inventors: Ching Sheng Yu, New Taipei (TW); Chih Liang Wang, Keelung (TW); Kuang Hui Chen, New Taipei (TW)

(73) Assignee: Groups Tech Co., Ltd. (TW)

( * ) Notice: Subject to any disclaimer, the term of this patent is extended or adjusted under 35 U.S.C. 154(b) by 0 days.

(21) Appl. No.: 14/164,236

(22) Filed: Jan. 26, 2014

(65) Prior Publication Data

US 2014/0210351 A1 Jul. 31, 2014

(30) Foreign Application Priority Data

Jan. 31, 2013 (TW) ..... 102103700 A
Nov. 6, 2013 (TW) ..... 102140348 A

(51) Int. Cl.
*H05B 41/36* (2006.01)
*H05B 33/08* (2006.01)

(52) U.S. Cl.
CPC ..... *H05B 33/083* (2013.01)

(58) Field of Classification Search
USPC ..... 315/291, 295, 294, 122, 124, 224, 312
See application file for complete search history.

(56) References Cited

U.S. PATENT DOCUMENTS

| | | | | |
|---|---|---|---|---|
| 7,688,002 | B2 * | 3/2010 | Ashdown et al. | 315/291 |
| 8,324,840 | B2 * | 12/2012 | Shteynberg et al. | 315/308 |
| 2010/0060175 | A1 * | 3/2010 | Lethellier | 315/164 |
| 2011/0199003 | A1 * | 8/2011 | Muguruma et al. | 315/122 |
| 2012/0104952 | A1 * | 5/2012 | Chen | 315/122 |
| 2013/0026925 | A1 * | 1/2013 | Ven et al. | 315/122 |

* cited by examiner

*Primary Examiner* — Ming D A

(57) ABSTRACT

Disclosed are electronic control gears for LED light engines able to improve power factor by way of gearing up or down the LED current and the AC input current in response to and in synchronization with the AC input voltage. Moreover, the disclosed electronic control gears could further reduce flicker phenomenon and total harmonic distortion when used in collocation with disclosed valley fillers, filling the LED current valleys only during the dead time, and in conjunction with disclosed dummy loads, ramping up or down the AC input current only during the dead time.

18 Claims, 13 Drawing Sheets

ELECTRONIC CONTROL GEARS FOR LED LIGHT ENGINE AND APPLICATION THEREOF

BACKGROUND OF THE INVENTION

1. Field of the Invention

The invention relates to electronic control gears for LED (light emitting diode) light engine. In particular, the electronic control gears for LED light engine use the normally closed electronic switches to gear up or down the number and current of excited LEDs in the LED array segments in accordance with the level of the AC input voltage in order to improve the power factor. Furthermore, valley fillers and/or dummy loads can be optionally added in to improve the flicker phenomenon and/or decrease the total harmonic distortion, respectively.

2. Description of the Prior Art

As compared with the traditional lighting devices, the LED has a higher luminous efficacy. The LEDs can give off more than 100 lumens per watt because less electric energy is converted into waste heat. In sharp contrast, a traditional bulb only gives off about 15 lumens per watt because more electric energy is converted into waste heat. Moreover, LED-based lighting devices are gradually becoming the preferred lighting equipment because of having a relatively longer life to reduce maintaining cost, being less susceptible to exterior interference, and being less likely to get damaged.

Technically, LEDs need to be DC-driven. So, an AC sinusoidal voltage source would normally be rectified by a full-wave or half-wave rectifier into a rectified sinusoidal voltage source before coming into use. In the vicinity of the beginning and end of each DC pulse cycle (aka "dead time") where the input voltage is lower than the total forward voltage drop of the LEDs, the LEDs cannot be forward-biased to light up. The dead time is the partial period during which the LED current ceases conduction while the conduction angle is the partial period during which the circuit conducts the LED current. The dead time in union with the conduction angle constitutes a full period of the rectified sinusoidal voltage pulse. A longer dead time translates to a smaller conduction angle, and hence a lower power factor; more specifically, the longer the dead time, the smaller the conduction angle, and the lower the power factor, because the line current is getting too thin to be similar in shape to the line voltage. Traditional LED drivers usually come along with three application problems.

The first problem would be the need for a more complicated and more expensive driving circuit consisting of a filter, a rectifier, and a power factor corrector (PFC), etc. to drive LEDs. Besides, the short-life electrolytic capacitor used as an energy-storage component in the PFC is the key reason accounting for the shortened overall lifespan of the whole LED illumination apparatus, cancelling out the virtues of LED lighting.

The second problem would be the flicker phenomenon due to no current flowing through the LEDs during the dead time. The LEDs would immediately light up with a positive driving current, and go out with a zero driving current, causing the LEDs to flicker if there exists a dead time. If a typical AC sinusoidal frequency is 60 Hz, the rectified sinusoidal frequency will double as 120 Hz. The flicker phenomenon indeed takes place during the dead time at a repetition rate of twice the AC sinusoidal frequency although its existence might hardly be perceived by human eyes.

The third problem would be a relatively lower power factor exhibited by a low-power PFC with a loop current too weak to be precisely sensed to correctly shape the AC input current into a sinusoidal waveform. The power factor (PF) can be calculated as the input power divided by the product of the input voltage (line voltage) and the input current (line current), i.e. $PF=P/(V\times I)$, wherein P is the input power, and V and I are respectively the root-mean-square values of the line voltage and the line current. The power factor is used to measure the electricity utilization. The more similar the line current is to the line voltage, the better the electricity utilization and the higher the power factor. When the line current and the line voltage are consistent in terms of identical phase and identical shape, the power factor would reach 1 (the maximum value). The conventional PFC needs to sense its loop current for the purpose of aligning the line current with the line voltage. If the loop current goes too low to be precisely sensed by the current sense circuitry in the PFC stage, the PFC would fail to properly keep the line current in phase and in shape with the line voltage to achieve a high power factor. Often mentioned in the same breath with the issue of a low PF is the issue of a high total harmonic distortion (THD). According to the theory of Fourier series expansion of any periodic signal, any discontinuous or jumping points in the periodic waveform would incur higher-order harmonics on top of the fundamental component, causing the THD to increase. The THD resulting from the discontinuous or jumping points in the AC input current waveform would have much to do with the existence of the dead time.

Simplifying the electronic circuit, reducing the manufacturing and maintaining costs, eliminating the flicker phenomenon, as well as improving the power factor still remain the main topics put at the top of the agenda when it comes to developing new LED lighting apparatuses. The invention proposed herein to address the above issues provides an LED light engine, allowable to directly operate off of an AC power supply, in an attempt to get many benefits such as low cost, high performance, long lifespan, simple circuit topology, low flicker phenomenon, and high power factor.

SUMMARY OF THE INVENTION

The invention embodiments provide electronic control gears for LED light engine. Along the rising edge of the rectified sinusoidal input voltage, the electronic control gears for LED light engine successively light up the LED array segments; along the falling edge of the rectified sinusoidal input voltage, the electronic control gears for LED light engine successively put out the LED array segments. The invention embodiments have benefits of simplifying the electronic circuits, improving the luminous efficacy and power factor, as well as reducing the manufacturing and maintaining costs, etc. The electronic control gears for LED light engine provided by the invention embodiments are essentially equipped with a rectifier (such as a full-wave or half-wave rectifier) for AC-to-DC conversion.

An optional valley filler, connected to the two DC output terminals of the rectifier and in parallel with the LED light engine, fills up the LED current valleys with a preset constant current only during the dead time to improve the flicker phenomenon.

An optional dummy load, connected to the two DC output terminals of the rectifier and in parallel with the LED light engine, draws a line current only during the dead time to decrease the total harmonic distortion by eliminating the discontinuous or jumping points.

The electronic control gears for LED light engine provided by the invention embodiments comprise a switch regulator chain connected in parallel with an LED array chain. The LED array chain comprises a plurality of LED array segments connected in series. The switch regulator chain comprises a plurality of switch regulators connected in series. Each switch regulator is connected in parallel with a corresponding LED array segment, except for the lowest segment of the LED array chain.

Each switch regulator comprises a bypass switch and a detector. The bypass switch is implemented with a normally closed electronic switch, acting like a short circuit with an adequate nonnegative gate-source voltage ($0 \leq V_{GS} < V_{pbr}$) and behaving like an open circuit with a sufficiently large negative gate-source voltage ($V_{nbr} < V_{GS} < V_{th} < 0$), wherein $V_{th}$ is the cutoff threshold voltage, $V_{pbr}$ is the positive breakdown voltage, and $V_{nbr}$ is the negative breakdown voltage. Either an n-channel depletion-mode metal-oxide-semiconductor field-effect transistor (n-channel depletion-mode MOSFET) or an n-channel depletion-mode junction field-effect transistor (n-channel depletion-mode JFET) can be employed as the bypass switch. If an adequate nonnegative gate-source voltage ($0 \leq V_{GS} < V_{pbr}$) is applied to the gate and source, the channel is enhanced to above its ON state. If a sufficiently large negative gate-source voltage ($V_{nbr} < V_{GS} < V_{th} < 0$) is applied to the gate and source, the channel is depleted to below its OFF state.

The detector can take on any type of a current detector, a voltage detector, an optical detector, a magnetic detector, or a comparator, wherein the current or voltage detector would be the preferred choice.

During the first half of the period, the rectified sinusoidal input voltage goes up to its peak from its zero. When the rising input voltage is still insufficient to forward-bias the lower LED array segment connected to the bottom of the present bypass switch, the present detector receives a below-threshold voltage/current sense signal, and the present bypass switch remains in its ON state to short out the present LED array segment connected in parallel with it. When the rising input voltage has been high enough to forward-bias the lower LED array segment connected to the bottom of the present bypass switch, the present detector receives a jittering voltage/current sense signal, and the present bypass switch regulates the LED current of the lower LED array segment subsequent to it at a preset constant level. When the rising input voltage has been high enough to forward-bias the present LED array segment connected in parallel with the present bypass switch, the present detector receives an at-threshold voltage/current sense signal, and the present bypass switch is shut off because of a higher current level regulated by the higher bypass switch connected to the top of it. In this way, the electronic control gear lights up each segment in the LED array segments from the bottom up.

During the second half of the period, the rectified sinusoidal input voltage goes down to its zero from its peak. When the falling input voltage is still high enough to forward-bias the present LED array segment connected in parallel with the present bypass switch, the present detector receives an at-threshold voltage/current sense signal, and the present bypass switch is shut off because of a higher current level regulated by the higher bypass switch connected to the top of it. When the falling input voltage is still high enough to forward-bias the lower LED array segment connected to the bottom of the present bypass switch, the present detector receives a jittering voltage/current sense signal, and the present bypass switch regulates the LED current of the lower LED array segment subsequent to it at a preset constant level. When the falling input voltage has been insufficient to forward-bias the lower LED array segment connected to the bottom of the present bypass switch, the present detector receives a below-threshold voltage/current sense signal, and the present bypass switch switches back to its ON state to short out the present LED array segment connected in parallel with it. In this way, the electronic control gear puts out each segment in the LED array segments from the top down.

The valley filler provided by the invention embodiments comprises a programmable constant current source and at least one energy storage capacitor. The programmable constant current source is used to charge the energy storage capacitor with a preset constant current to make the capacitor voltage fit for valley filling.

When the input voltage is higher than the energy storage capacitor voltage, the energy storage capacitor is charged with a first preset constant current for the capacitor voltage to reach an intermediate voltage level between $V_{f1}$ and $V_{f1}+V_{f2}$, where $V_{f1}$ and $V_{f2}$ stand for the forward voltage drop of the lowest and the second lowest LED array segments in the LED arrays, respectively. When the input voltage is lower than the energy storage capacitor voltage, the energy storage capacitor is discharged with a second preset constant current to light up the lowest LED array segment only during the dead time to improve the flicker phenomenon.

The dummy load provided by the invention embodiment comprises a controlled switch and a resistive load. The controlled switch electrically couples the resistive load to the two DC output terminals of the rectifier only within the dead time, and then cuts off the resistive load. The resistive load draws a line current only during the dead time to decrease the total harmonic distortion by means of stuffing up the dead time in the line current waveform for eliminating the discontinuous or jumping points.

Only during the dead time, the controlled switch is turned on to connect the resistive load to the two DC output terminals of the rectifier. Elsewhere, the controlled switch is shut off to disconnect the resistive load from the two DC output terminals of the rectifier. Therefore, the dummy load can effectively help decrease the total harmonic distortion with no significant loss of power efficiency due to resistive consumption.

BRIEF DESCRIPTION OF THE DRAWINGS

The foregoing conceptions and their accompanying advantages of this invention will become more readily appreciated after being better understood by referring to the following detailed description, in conjunction with the accompanying drawings.

FIG. 7A illustrates the consistency between the LED current and the line current before the adoption of a valley filler. That is to say, both the LED current and the line current remain zero during the dead time with an indication of the flicker phenomenon. FIG. 7B illustrates the difference between the LED current and the line current after the adoption of a valley filler. The LED current valleys get filled up with a second preset constant current only during the dead time to improve the flicker phenomenon while the line current still stays zero because the reverse-biased rectifier blocks the road when the capacitor voltage is higher than the input voltage. The dead time in the line current also increases because the capacitor voltage has to be charged up to a voltage level higher than the forward voltage drop of the lowest LED array segment.

FIG. 9A illustrates discontinuous or jumping points due to a dead time before the adoption of a dummy load while FIG. 9B illustrates no discontinuous or jumping points due to no dead time after the adoption of a dummy load. The total harmonic distortion can be effectively decreased by eliminating discontinuous or jumping points from the line current with the use of a dummy load, drawing a line current only within the dead time.

DESCRIPTION OF THE PREFERRED EMBODIMENT

Figure 1:
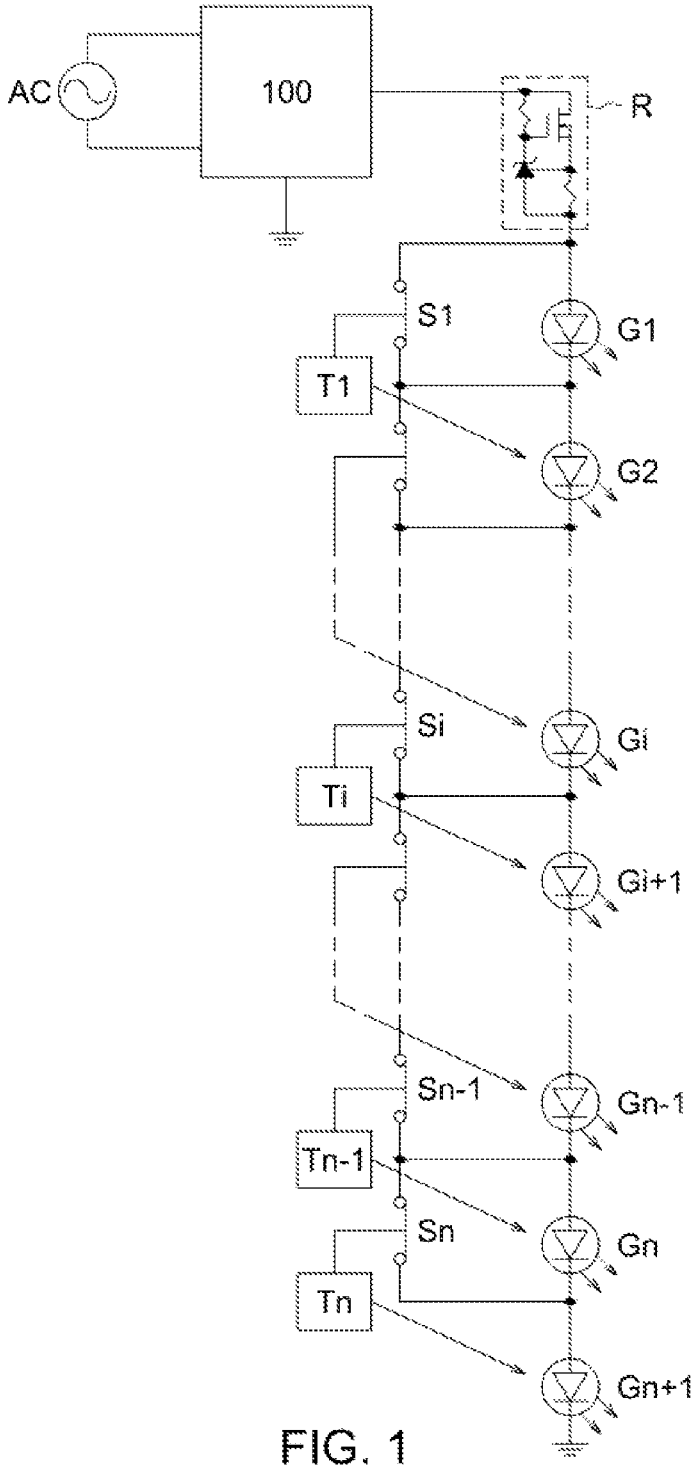
FIG. 1 illustrates a superordinate main circuit structure of the electronic control gears for LED light engine according to the embodiment of the invention. The electronic control gears for LED light engine comprise a switch regulator chain with a plurality of switch regulators connected in series. The switch regulator chain is connected in parallel with the LED array segments chain. Each switch regulator is connected in parallel with a corresponding LED array segment, except for the last segment of the LED array segments. The switch regulator comprises a bypass switch and a detector, wherein the bypass switch transits around three functional states: ON state, regulating state, and OFF state, depending on the signal sensing of the detector.

By nature, LEDs operate off of DC sources. As such, an AC sinusoidal voltage source would normally be rectified by a rectifier (such as a full-wave or half-wave rectifier) into a DC pulsating voltage source before being applied to an LED lighting device.

Similar in the unidirectional conduction property to an ordinary diode, an LED needs to get forward-biased, i.e. its forward voltage drop must be overcome by the rectified sinusoidal input voltage, before being able to be lit up by an exciting current. The partial period during which no current flows through the LED(s) is generally referred to as the dead time. The partial period during which current flows through the LED(s) is generally referred to as the conduction angle. The dead time in union with the conduction angle constitutes a full period of the rectified sinusoidal input voltage. The power factor is a measure of the similarity in both phase and shape between the line current and the line voltage. When an LED array segment consists of numerous series-connected LEDs, the overall forward voltage drop would put up a very high voltage barrier for the input voltage to get over, causing the dead time to be lengthened, the conduction angle to be shortened, and the power factor to be worsened because the line current in this case would look dissimilar in shape to the line voltage. In an attempt to improve the power factor, the present invention discloses a divide-and-conquer strategy for lighting up or putting out the LED array chain. That is, the LED array chain is divided into several LED array segments and each LED array segment is conquered one by one.

To solve the problem with a small conduction angle, a traditional way would be to take on a PFC to boost the rectified sinusoidal voltage to a DC voltage level higher than the total forward voltage drop of the LED array, so that the LED array could be lit up with the high DC voltage source applied to its two terminals. However, the electrolytic capacitor employed as an energy-storage element in the PFC is the most fragile and nondurable component, and against the long lifespan LED lighting equipment should live up to.

In the spirit of the present invention, the divide-and-conquer strategy would be to first divide the LED array chain into several LED array segments and then conquer each LED array segment one by one. This divide-and-conquer strategy could be carried out by utilizing the disclosed electronic control gear for LED light engine with a string of the switch regulators, wherein each switch regulator in the electronic control gear is correspondingly connected in parallel with each LED array segment in the LED array segment. Along the rising edge of the rectified sinusoidal voltage waveform, the LED array segments are lit up one by one and the LED current steps up from the bottom up. Along the falling edge of the rectified sinusoidal voltage waveform, the LED array segments are put out one by one and the LED current steps down from the top down. The quasi-sinusoidal line current closely following the sinusoidal line voltage, it is no surprise the power factor still can remain high without the aid of a traditional PFC on shaping the line current.

Please refer to FIG. 1 for the illustration of the superordinate main circuit structure of the electronic control gears for LED light engine according to the embodiment of the invention. First, the rectifier 100 is used to rectify the AC sinusoidal voltage source to a DC pulsating voltage source. Then, the current regulator R provides the LED array segment with the maximum regulated current in close proximity to the input voltage peak and protects the subsequent circuit against an over-current damage in case of a short-circuit fault.

The electronic control gear for LED light engine consists of a switch regulator chain connected in parallel with the LED array segments chain. The LED array segments chain has a plurality of LED array segments (represented as $G_1 \ldots G_i, \ldots, G_{n+1}$ in FIG. 1) connected in series. The switch regulator chain has a plurality of switch regulators connected in series. Except the lowest LED array segment, each LED array segment is connected in parallel with a corresponding switch regulator. Each switch regulator comprises a bypass switch (represented as $S_1, \ldots, S_i, \ldots, S_n$ in FIG. 1) and a detector (represented as $T_1, \ldots, T_i, T_n$ in FIG. 1).

The current regulator consists of a MOSFET, a shunt regulator or an npn BJT, and a current-sensing resistor. The MOSFET is used as a controlled switch. The shunt regulator or the npn BJT takes control over the turn-on or turn-off of the MOSFET according to the current signal sensed by the current-sensing resistor connected in series with the MOSFET.

Each switch regulator comprises a bypass switch ($S_1, \ldots, S_i, \ldots, S_n$) and a detector ($T_1, \ldots, T_i, \ldots, T_n$). The bypass switch ($S_1, \ldots, S_i, \ldots, S_n$) is implemented with a normally closed electronic switch, acting like a short circuit with an adequate nonnegative gate-source voltage ($0 \leq V_{GS} < V_{pbr}$) and behaving like an open circuit with a sufficiently large negative gate-source voltage ($V_{nbr} < V_{GS} < V_{th} < 0$), wherein $V_{th}$ is the cutoff threshold voltage, $V_{pbr}$ is the positive breakdown voltage, and $V_{nbr}$ is the negative breakdown voltage. Either an n-channel depletion-mode metal-oxide-semiconductor field-effect transistor (n-channel depletion-mode MOSFET) or an n-channel depletion-mode junction field-effect transistor (n-channel depletion-mode JFET) can be employed as the bypass switch ($S_1, \ldots, S_i, \ldots, S_n$). If an adequate nonnegative gate-source voltage ($0 \leq V_{GS} < V_{pbr}$) is applied to the gate and source, the channel is enhanced to above its ON state. If a sufficiently large negative gate-source voltage ($V_{nbr} < V_{GS} < V_{th} < 0$) is applied to the gate and source, the channel is depleted to below its OFF state.

The detector ($T_1, \ldots, T_i, \ldots, T_n$) can take on any type of a current detector, a voltage detector, an optical detector, a magnetic detector, or a comparator, wherein the current or voltage detector would be the preferred choice.

By means of sensing a voltage or current signal, the present detector ($T_i$) keeps an eye on the lower LED array segment ($G_{i+1}$) and then takes control over the present bypass switch ($S_i$).

The present bypass switch ($S_i$) has three functional states: ON state (shorting out the present LED array segment $G_i$), regulating state (regulating the lower LED array segment $G_{i+1}$ current), and OFF state (freeing up the present LED array segment $G_i$), depending on the control from the present detector ($T_i$).

During the first half of the period, the rectified sinusoidal input voltage goes up to its peak from its zero. When the rising input voltage is still insufficient to forward-bias the lower LED array segment $G_{i+1}$ connected to the bottom of the present bypass switch $S_i$, the present detector $T_i$ receives a below-threshold voltage/current sense signal, and the present bypass switch $S_i$ remains in its ON state to short out the present LED array segment $G_i$ connected in parallel with it. When the rising input voltage has been high enough to forward-bias the lower LED array segment $G_{i+1}$ connected to the bottom of the present bypass switch $S_i$, the present detector $T_i$ receives a jittering voltage/current sense signal, and the present bypass switch $S_i$ regulates the LED current of the lower LED array segment $G_{i+1}$ subsequent to it at a preset constant level. When the rising input voltage has been high enough to forward-bias the present LED array segment $G_i$ connected in parallel with the present bypass switch $S_i$, the present detector $T_i$ receives an at-threshold voltage/current sense signal, and the present bypass switch $S_i$ is shut off because of a higher current level regulated by the higher bypass switch $S_{i-1}$ connected to the top of it. In this way, the electronic control gear lights up each array segment in the LED arrays chain from the bottom up.

During the second half of the period, the rectified sinusoidal input voltage goes down to its zero from its peak. When the falling input voltage is still high enough to forward-bias the present LED array segment $G_i$ connected in parallel with the present bypass switch $S_i$, the present detector $T_i$ receives an at-threshold voltage/current sense signal, and the present bypass switch $S_i$ is shut off because of a higher current level regulated by the higher bypass switch $S_{i-1}$ connected to the top of it. When the falling input voltage is still high enough to forward-bias the lower LED array segment $G_{i+1}$ connected to the bottom of the present bypass switch $S_i$, the present detector $T_i$ receives a jittering voltage/current sense signal, and the present bypass switch $S_i$ regulates the LED current of the lower LED array segment $G_{i+1}$ subsequent to it at a preset constant level. When the falling input voltage has been insufficient to forward-bias the lower LED array segment $G_{i+1}$ connected to the bottom of the present bypass switch $S_i$, the present detector $T_i$ receives a below-threshold voltage/current sense signal, and the present bypass switch $S_i$ switches to its ON state to short out the present LED array segment $G_i$ connected in parallel with it. In this way, the electronic control gear puts out each array segment in the LED array chain from the top down.

Figure 2A:
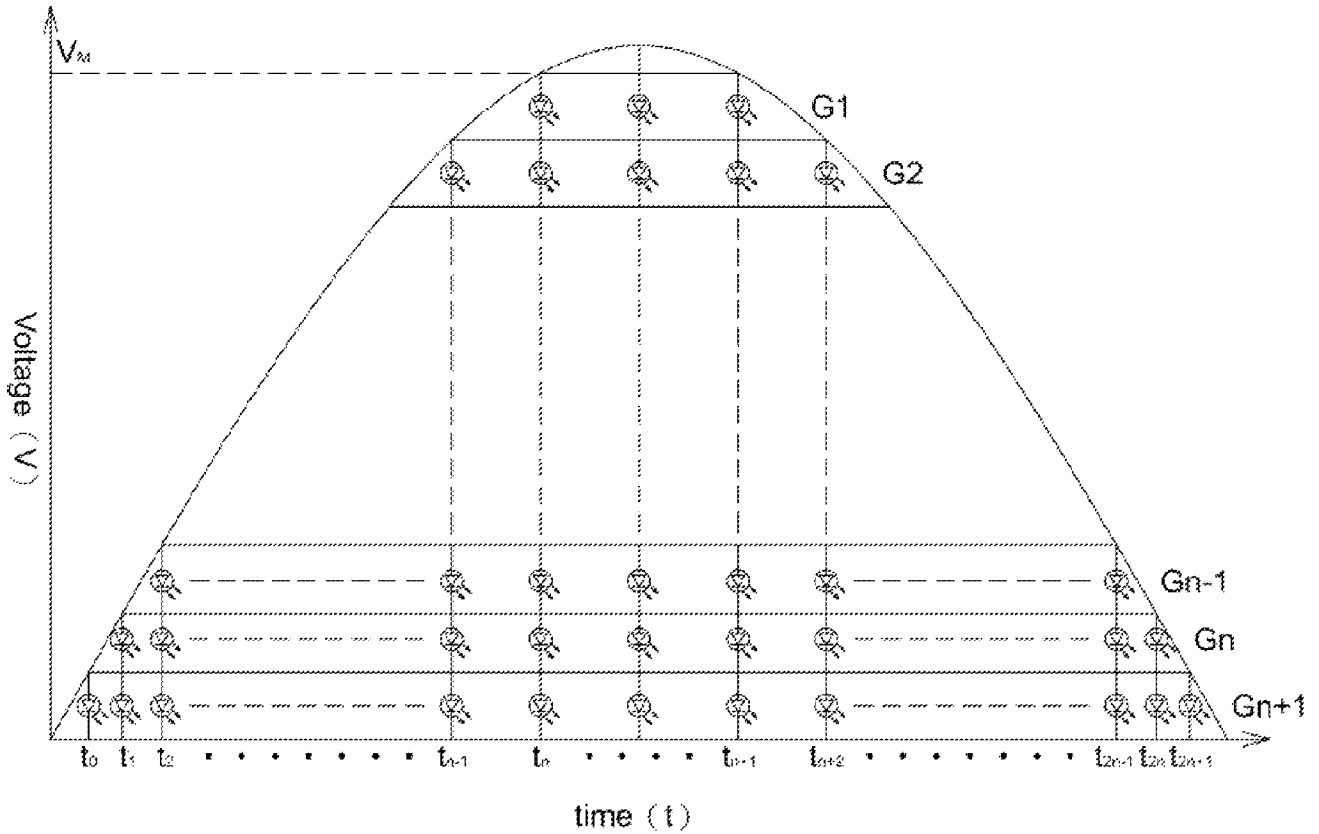
FIG. 2A illustrates the divide-and-conquer strategy for lighting up or putting out the LED array segments according to the embodiment of the invention. During the first half of the period, the gradually rising sinusoidal input voltage lights up each segment from the bottom up. During the second half of the period, the gradually falling sinusoidal input voltage puts out each segment from the top down.
Figure 2B:
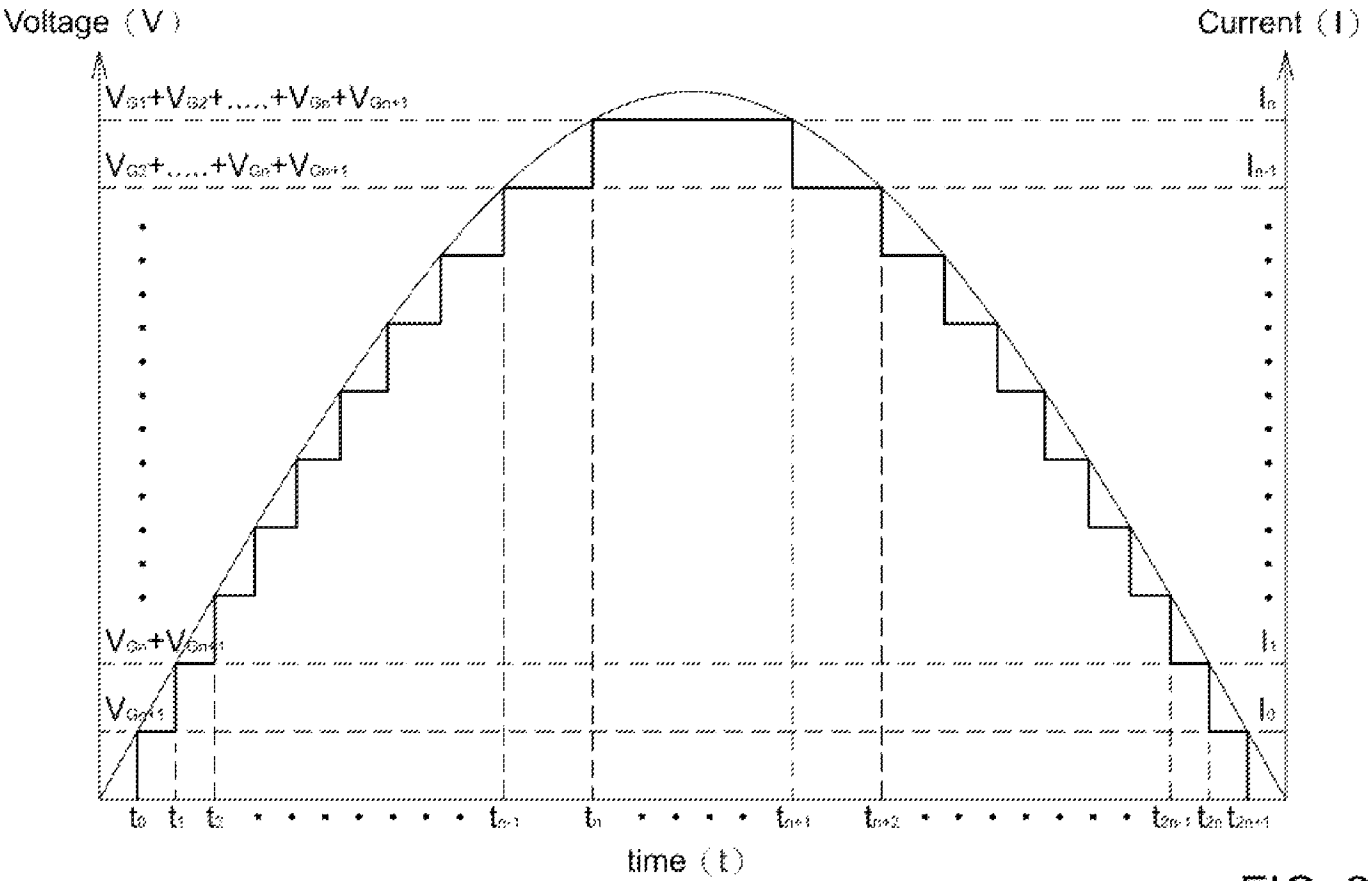
FIG. 2B illustrates the line current waveform corresponding to the divide-and-conquer strategy illustrated in FIG. 2A. During the first half of the period, each segment is lit up along the trajectory of a step-up waveform. During the second half of the period, each segment is put out along the trajectory of a step-down waveform. The quasi-sinusoidal line current closely follows the sinusoidal line voltage, so the power factor can be effectively improved to reach a very high level.

FIG. 2A illustrates the divide-and-conquer strategy for lighting up or putting out the LED array segment ($G_1, \ldots, G_i, \ldots, G_{n+1}$) in accordance with the embodiment of the invention. During the first half of the period, the gradually rising sinusoidal input voltage lights up each LED array segment from the bottom up. During the second half of the period, the gradually falling sinusoidal input voltage puts out each LED array segment from the top down. FIG. 2B illustrates the line current waveform corresponding to the divide-and-conquer strategy illustrated in FIG. 2A. During the first half of the period, each segment is lit up along the trajectory of a step-up waveform. During the second half of the period, each segment is put out along the trajectory of a step-down waveform. The quasi-sinusoidal line current closely following the sinusoidal line voltage, a high power factor has been achieved.

During the period of ($0\sim t_0$) shown in FIG. 2A, the input voltage still fails to overcome the forward voltage drop of the lowest LED array segment ($G_{n+1}$) ($V_i<V_{Gn+1}$, $V_i$ represents the input voltage), the lowest bypass switch ($S_n$) remains in its ON state but no current flows through the LED array segments ($G_1, G_2, \ldots, G_{n+1}$), leading to the formation of dead time. FIG. 2B illustrates no LED current within the dead time ($0\sim t_0$).

During the period of ($t_0\sim t_1$) shown in FIG. 2A, the input voltage has been able to overcome the forward voltage drop of the lowest LED array segment ($G_{n+1}$), but is still unable to overcome the total forward voltage drop of the lowest and the second lowest LED array segments ($G_{n+1}+G_n$) ($V_{Gn+1}\leq V_i<V_{Gn+1}+V_{Gn}$), the lowest LED array segment ($G_{n+1}$) is lit up by a current flowing through the bypass switches ($S_1, \ldots, S_i, \ldots, S_n$). During this period, the lowest bypass switch ($S_n$) moves out of its ON state and stays in its regulating state under the control of the lowest detector ($T_n$). The actual current flowing through the lowest LED array segment ($G_{n+1}$) during this period is regulated at a lowest preset current level $I_0$ by way of quickly switching the lowest bypass switch ($S_n$) between its ON state and its OFF state. If the actual current is lower than $I_0$, the lowest bypass switch ($S_n$) is quickly switched to its ON state for the actual current to go up to $I_0$. If the actual current is higher than $I_0$, the lowest bypass switch ($S_n$) is quickly switched to its OFF state for the actual current to go down to $I_0$. FIG. 2B in conjunction with FIG. 2A gives an indication of a constant current $I_0$ flowing through the lowest LED array segment ($G_{n+1}$) during the period of ($t_0\sim t_1$).

During the period of ($t_1\sim t_2$) shown in FIG. 2A, the input voltage has been able to overcome the total forward voltage drop of the lowest and the second lowest LED array segments ($G_{n+1}+G_n$) ($V_{Gn+1}+V_{Gn}\leq V_i$), the lowest bypass switch ($S_n$) is locked down into its OFF state under the control of the lowest detector ($T_n$) during this period, the lowest and the second lowest LED array segments ($G_{n+1}, G_n$) are lit up by a current flowing through the bypass switches ($S_1, \ldots, S_i, \ldots, S_{n-1}$). The second lowest detector ($T_{n-1}$) receives a jittering voltage/current sense signal, so the second lowest bypass switch ($S_{n-1}$) enters its regulating state and the LED current is regulated at current $I_1$. Because current $I_1$ is larger than current $I_0$ ($I_1>I_0$), the lowest detector ($T_n$) receives an at-threshold voltage/current sense signal and the lowest bypass switch ($S_n$) enters its OFF state. At time $t_1$, the input voltage just gets over the voltage barrier put up by the total forward voltage drop of the lowest and the second lowest LED array segments ($G_{n+1}, G_n$), and the LED current skyrockets to a second lowest preset current level $I_1$ regulated by the second lowest bypass switch ($S_{n-1}$) during this period because the loop impedance seen by the voltage difference between the input voltage and the total forward voltage drop is very small.

During the first half period, the bypass switches are switched in the ON-regulating-OFF sequence to light up the LED array segments ($G_{n+1}, G_n, \ldots, G_i, \ldots, G_2, G_1$) from the bottom up, as is depicted in FIG. 2A, and the step-up waveform ($I_0<I_1<\ldots<I_n$) is shown in FIG. 2B. During the second half period, the bypass switches are switched in the OFF-regulating-ON sequence to put out the LED array segments ($G_1, G_2, \ldots, G_i, \ldots, G_n, G_{n+1}$) from the top down, as is depicted in FIG. 2A, and the step-down waveform ($I_n>I_{n-1}>\ldots>I_0$) is shown in FIG. 2B.

It is worth noting all of the LED array segments ($G_{n+1}, G_n, \ldots, G_i, \ldots, G_2, G_1$) are lit up by a maximum current $I_n$ regulated by the current regulator R during the period of ($t_n\sim t_{n+1}$) in close proximity to the input voltage peak, as is shown in FIG. 2B.

Figure 3:
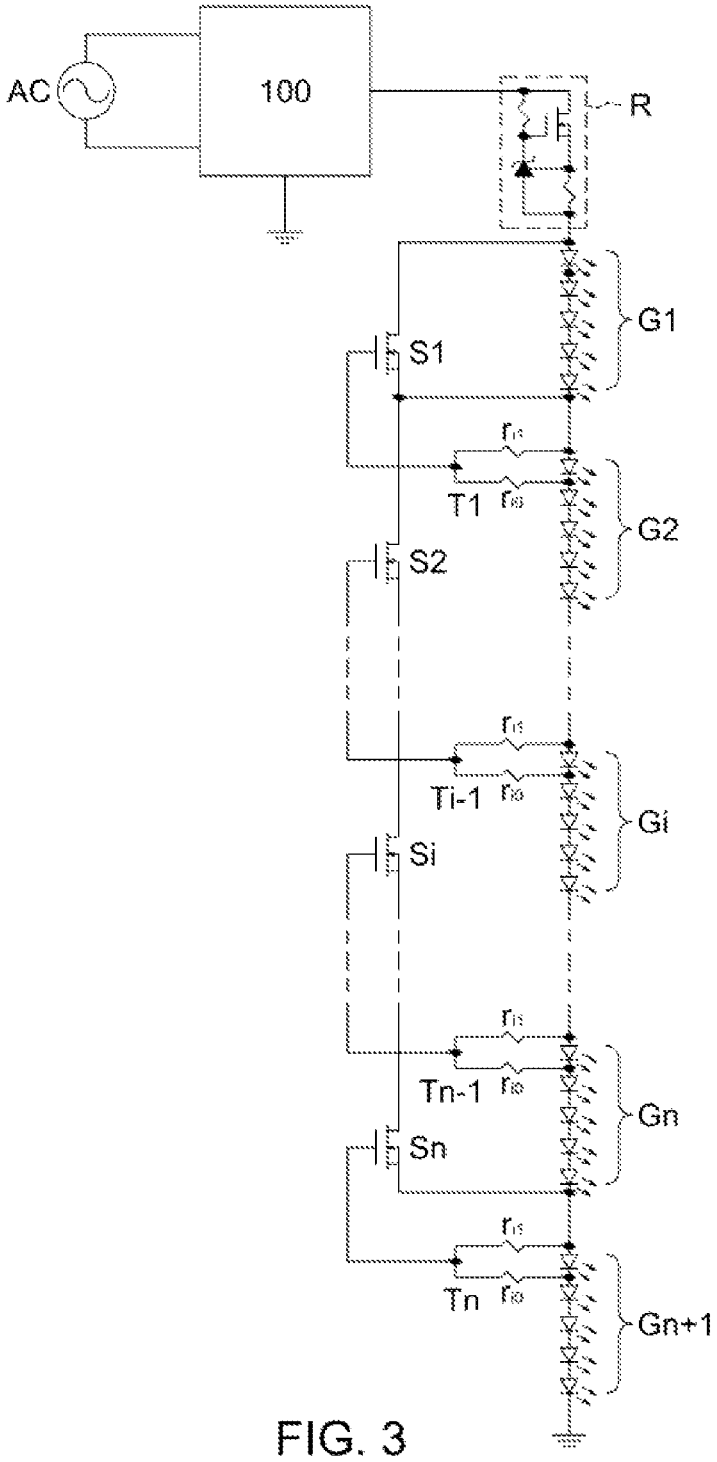
FIG. 3 reveals the LED lighting equipment having the electronic control gears for LED light engine according to the embodiment of the invention, where an n-channel depletion-mode MOSFET (depletion n-MOSFET) is used as the bypass switch, a voltage divider is used as the detector, and the present detector detects the partial or full forward voltage drop of the lower LED array segment to control the operating modes of the present bypass switch.
Figure 4:
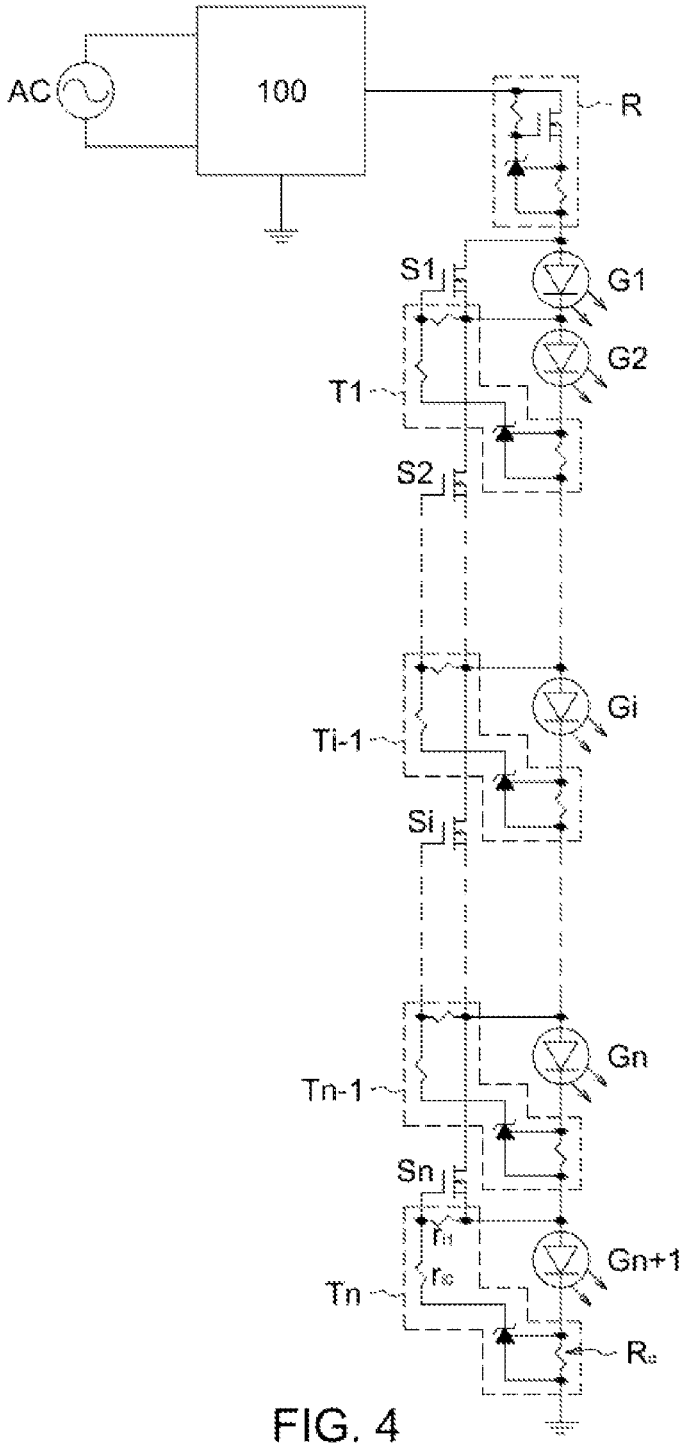
FIG. 4 reveals the LED lighting equipment having the electronic control gears for LED light engine according to the embodiment of the invention, where an n-channel depletion-mode MOSFET is used as the bypass switch, and a shunt regulator is used as a current detector to control the operating modes of the n-channel depletion-mode MOSFET.
Figure 5:
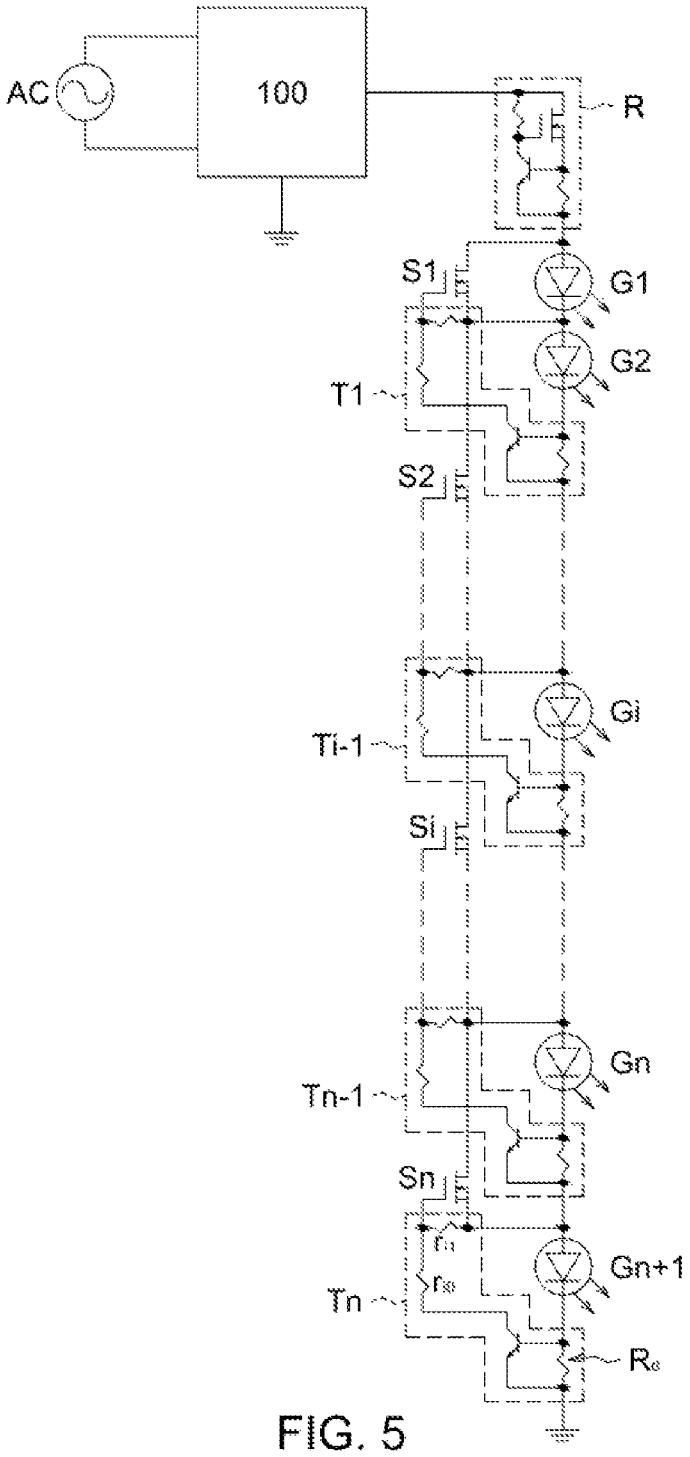
FIG. 5 reveals the LED lighting equipment having the electronic control gears for LED light engine according to the embodiment of the invention, where an n-channel depletion-mode MOSFET is used as the bypass switch, and an npn bipolar junction transistor (BJT) is used as a current detector to control the operating modes of the n-channel depletion-mode MOSFET.

FIGS. 3~5 illustrate a specific electronic circuit structure as an example according to the embodiment of the invention. It goes without saying the exemplary embodiments are used to describe the implementations, but not to limit the scope of the invention. FIG. 3 illustrates the technical means of voltage detection, while FIGS. 4, 5 illustrate the technical means of current detection.

Please take a look at FIG. 3, where the bypass switch ($S_i$) is realized with an n-channel depletion-mode MOSFET, acting like a short circuit with an adequate nonnegative gate-source voltage ($0\leq V_{GS}<V_{pbr}$) and behaving like an open circuit with a sufficiently large negative gate-source voltage ($V_{nbr}<V_{GS}<V_{th}<0$), wherein $V_{th}$ is the cutoff threshold voltage, $V_{pbr}$ is the positive breakdown voltage, and $V_{nbr}$ is the negative breakdown voltage.

The present detector ($T_i$) is a voltage divider (resistors ($r_{i0}$, $r_{i1}$) connected in series) connected to two terminals of at least one LED in the lower LED array segment ($G_{i+1}$). Whenever the lit-up lower LED array segment ($G_{i+1}$)'s partial or full forward voltage drop is sensed by the voltage divider, the present bypass switch ($S_i$)'s gate and source receive a negative voltage $V_{GS}=-V_F\times r_{i1}/(r_{i0}+r_{i1})$, wherein the voltage $V_F$ stands for the sensed LEDs' forward voltage drop, to regulate the LED current by modulating the present bypass switch ($S_i$)'s channel resistance in the linear/triode region. FIG. 3 is just an exemplified diagram and, of course, the actual voltage divider can connect to more than one LED.

The present bypass switch ($S_i$) implemented with an n-channel depletion-mode MOSFET as a normally closed electronic switch would normally remain in its ON state whenever its gate and source does not receive any driving voltage. During the period of ($0\sim t_0$) shown in FIG. 2B, the input voltage applied to the lowest LED array segment ($G_{n+1}$) through the closed bypass switch array ($S_1, S_2, \ldots, S_n$) still fails to overcome its forward voltage drop ($V_i<V_{Gn+1}$), and no current flows through the LEDs, leading to the formation of dead time.

During the period ($t_0\sim t_1$), the input voltage has been able to overcome the forward voltage drop of the lowest LED array segment ($G_{n+1}$), but is still unable to overcome the total forward voltage drop of the lowest and the second lowest LED array segments of arrays ($G_{n+1}, G_n$) ($V_{Gn+1}\leq V_i<V_{Gn}+V_{Gn+1}$). The lowest LED array segment ($G_{n+1}$) is lit up by a current flowing through the bypass switch array ($S_1, S_2, \ldots, S_n$) after a current jump at time $t_0$. The present detector ($T_n$) receives a jittering voltage sense signal, and the present bypass switch ($S_n$) enters its regulating state, so the LED current is regulated at a constant current $I_0$, as is shown in FIG. 2B.

During the period of ($t_1\sim t_2$) shown in FIG. 2A, the input voltage has been able to overcome the total forward voltage drop of the lowest and the second lowest LED array segments ($G_{n+1}$+$G_n$) ($V_{Gn+1}$+$V_{Gn}$≤$V_i$), the lowest bypass switch ($S_n$) is locked down into its OFF state under the control of the lowest detector ($T_n$) during this period, the lowest and the second lowest LED array segments ($G_{n+1}$, $G_n$) are lit up by a current flowing through the bypass switches ($S_1$, . . . , $S_i$, . . . , $S_{n-1}$). The second lowest detector ($T_{n-1}$) receives a jittering voltage sense signal, so the second lowest bypass switch ($S_{n-1}$) enters its regulating state and the LED current is regulated at current $I_1$. Because current $I_1$ is larger than current $I_0$ ($I_1$>$I_0$), the lowest detector ($T_n$) receives an at-threshold voltage sense signal and the lowest bypass switch ($S_n$) enters its OFF state. At time $t_1$, the input voltage just gets over the voltage barrier put up by the total forward voltage drop of the lowest and the second lowest LED array segments ($G_{n+1}$, $G_n$), and the LED current skyrockets to a second lowest preset current level $I_1$ regulated by the second lowest bypass switch ($S_{n-1}$) during this period because the loop impedance seen by the voltage difference between the input voltage and the total forward voltage drop is very small.

Please turn to FIG. 4 and FIG. 5, illustrating the embodiment of the current-sensing detector ($T_i$). As is shown in FIG. 4, the current-sensing detector ($T_i$) comprises a shunt regulator, a detecting resistor $R_d$, and a voltage divider (consisting of resistors ($r_{i0}$, $r_{i1}$) connected in series), wherein the reference terminal (R) and the anode (A) of the shunt regulator are wired to the detecting resistor $R_d$ connected in series with each LED array segment, the cathode (K) of the shunt regulator connects to the gate and source terminals of the n-channel depletion-mode MOSFET (bypass switch ($S_i$)) through the voltage divider.

The feature of a shunt regulator would be: the channel between the cathode and anode is formed up when the reference-anode voltage equals to the reference voltage ($V_{RA}$=$V_{ref}$), and cut off when the reference-anode voltage is smaller than the reference voltage ($V_{RA}$<$V_{ref}$). A zero or sufficiently large negative driving voltage is generated through the voltage divider and then applied to the normally closed bypass switch's gate and source, respectively depending upon the OFF or ON states of the shunt regulator, to regulate the LED current by quickly switching the bypass switch between its saturation and cutoff regions.

During the period of (0~$t_0$) (i.e., dead time) shown in FIG. 2B, the input voltage is still unable to get over the forward voltage drop of the lowest LED array segment ($G_{n+1}$) ($V_i$<$V_{Gn+1}$), no current flows through the detecting resistor $R_d$, the shunt regulator's reference terminal and anode receives a zero current-sense signal ($V_{RA}$=0), and the lowest bypass switch ($T_n$) remains in its ON state.

During the period ($t_0$~$t_1$), the input voltage has been able to overcome the forward voltage drop of the lowest LED array segment ($G_{n+1}$), but is still unable to overcome the total forward voltage drop of the lowest and the second lowest LED array segments ($G_{n+1}$+$G_n$) ($V_{Gn+1}$≤$V_i$<$V_{Gn+1}$+$V_{Gn}$). Receiving a jittering current-sense signal from the detecting resistor $R_d$, the lowest shunt regulator quickly switches the lowest bypass switch ($S_n$) between its saturation and cutoff regions so as to regulate the LED current at a preset constant current level $I_0$.

During the period of ($t_1$~$t_2$), the input voltage has overcome the total forward voltage drop of the lowest and the second lowest LED array segments ($G_{n+1}$+$G_n$) ($V_{Gn+1}$+$V_{Gn}$≤$V_i$), the lowest and the second lowest LED array segments ($G_{n+1}$,$G_n$) are lit up by a current flowing through the bypass switches ($S_1$, . . . , $S_i$, . . . , $S_{n-1}$). Receiving a jittering current-sense signal from the detecting resistor $R_d$, the second lowest shunt regulator quickly switches the second lowest bypass switch ($S_{n-1}$) between its saturation and cutoff regions so as to regulate the LED current at a constant current level $I_1$. The lowest shunt regulator receives an at-threshold current-sense signal ($V_{RA}$=$V_{ref}$) from the detecting $R_d$ to lock down the lowest bypass switch ($S_n$) into its OFF state.

In this manner, each LED array segment ($G_{n+1}$, $G_n$, . . . , $G_1$) are lit up from the bottom up during the first half of the period, and put out from the top down during the second half of the period.

As an alternative to providing another embodiment of a current-sensing detector, FIG. 5 slightly differs from FIG. 4 only in the replacement of the shunt regulator with an npn BJT. The base (B) and the emitter (E) of the npn BJT are wired to the detecting resistor $R_d$ connected in series with each LED array segment, the collector (C) of the npn BJT connects to the gate and source terminals of the n-channel depletion-mode MOSFET (bypass switch ($S_i$)) through the voltage divider ($r_{i0}$, $r_{i1}$). Identical to the operating principle of FIG. 4, the operating principle of FIG. 5 won't be herein repeated. However, there is a significant contrast between voltage-sensing detector (FIG. 3) and current-sensing detector (FIG. 4 and FIG. 5) for the implementation of current regulation. The present bypass switch ($S_i$) is operated in the linear/triode region if the present detector takes the voltage-sense approach or in the saturation/cutoff regions if the present detector takes the current-sense approach for the LED current to be regulated at the preset current level. In view of the realization with the current-sense approach, current regulation could be simply achieved by quickly switching the bypass switch in response to the comparison between the current-sense signal and a reference voltage. There is no doubt other types of comparators can also be used.

Although having a high power factor, the above-mentioned embodiments still suffer from the annoying flicker phenomena, appearing at a repetition rate of twice the AC sinusoidal frequency especially when the LED current waveform has a dead time causing perceivable/unperceivable variation in the LED brightness. The flicker phenomena might lead to eyestrain or other diseases when human eye is exposed to its impact for a long time in accordance with some relevant medical reports. To solve the issue with flicker phenomena, the inventors provide several types of valley filler, able to fill up valleys of the LED current waveform only during the dead time.

FIGS. 6A, 6B, 6C, and 6D illustrate different types of the embodiment for valley filler. The valley filler comprises at least one energy storage capacitor and a programmable constant current source. The programmable constant current source is used to charge the energy storage capacitor with a preset constant current to make the energy storage capacitor voltage fit for valley filling. When the input voltage is higher than the energy storage capacitor voltage, the energy storage capacitor is charged with a first preset constant current for the capacitor voltage to reach an intermediate voltage level between $V_{f1}$ and $V_{f1}$+$V_{f2}$, where $V_{f1}$ and $V_{f2}$ stand for the forward voltage drop of the lowest and the second lowest LED array segments in the LED array chain, respectively. When the input voltage is lower than the capacitor voltage, the energy storage capacitor is discharged with a second preset constant current to light up the lowest LED array segment only during the dead time to improve the flicker phenomenon.

Figure 6A:
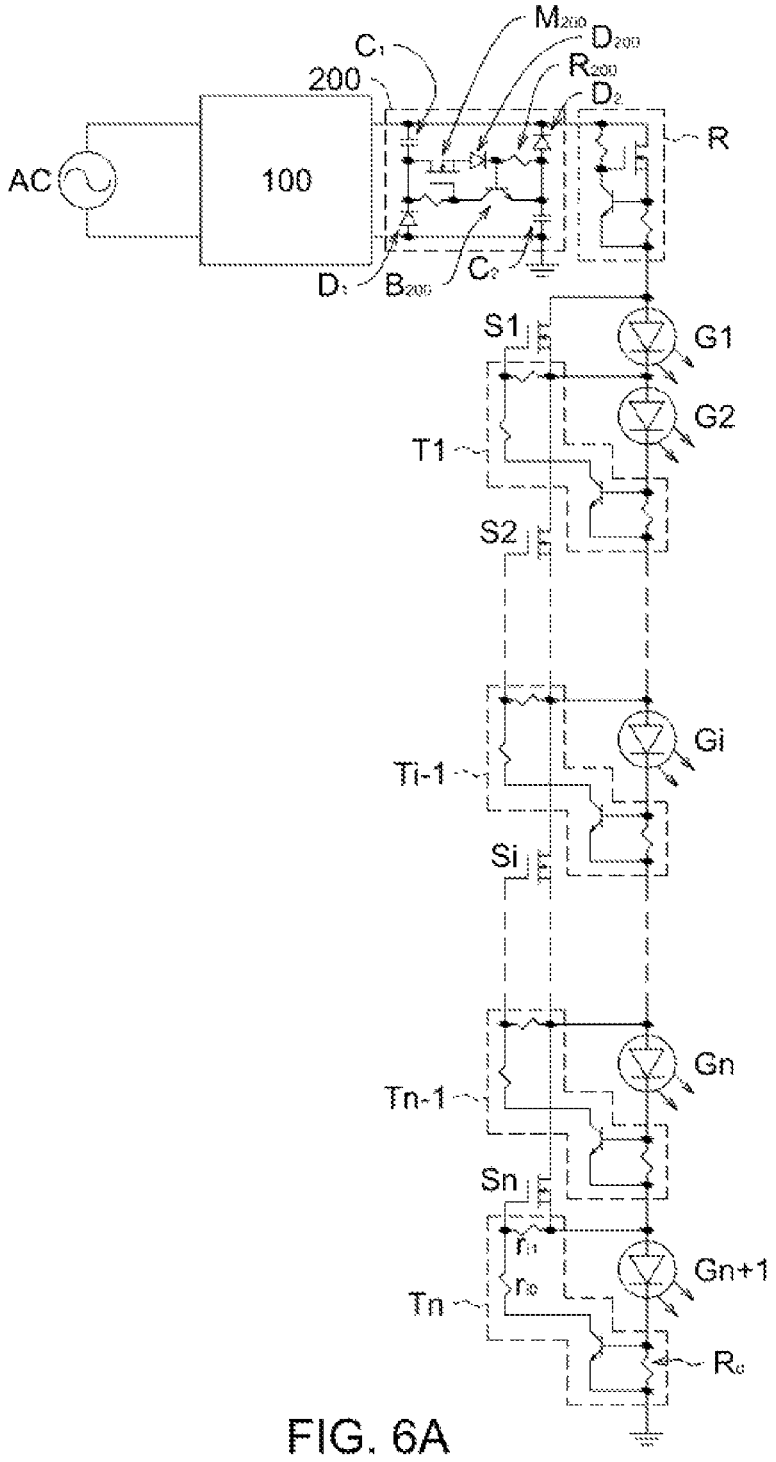
FIG. 6A unveils the LED lighting equipment with an optional double-capacitor valley filler according to the embodiment of the invention, wherein the double-capacitor valley filler is connected to the two DC output terminals of the rectifier and in parallel with the LED light engine to further address the thorny problem with LED flicker phenomenon. The double-capacitor valley filler comprises two energy storage capacitors and a programmable constant current source. The programmable constant current source comprises a MOSFET, a diode and a BJT. When the input voltage is higher than the energy storage capacitor voltage, the energy storage capacitor is charged with a first preset constant current for the capacitor voltage to reach a voltage level suitable for valley filling. When the input voltage is lower than the energy storage capacitor voltage, the energy storage capacitor is discharged with a second preset constant current to light up the lowest LED array segment only during the dead time to improve the flicker phenomenon. The feature of this embodiment would be: the two energy storage capacitors get charged in series in the time of a higher input voltage and discharged in parallel in the time of a lower input voltage.

First of all, the circuit structure and operating principle of a valley filler are briefly described hereafter with reference to FIG. 6A. The valley filler 200 is connected to the two DC output terminals of the rectifier 100 (full-wave or half-wave rectifier) and in parallel with the LED light engine to deal with LED flicker phenomenon issue. The valley filler 200 comprises a first energy storage capacitor $C_1$, a second energy storage capacitor $C_2$, a first diode $D_1$, a second diode $D_2$, and a programmable constant current source, wherein the programmable constant current source comprises a transistor $M_{200}$, a diode $D_{200}$, a resistor $R_{200}$, an npn bipolar transistor $B_{200}$, and a pull-up resistor. The base (B) and emitter (E) of the npn bipolar transistor $B_{200}$ are wired to the resistor $R_{200}$ connected in series with the transistor $M_{200}$ and the diode $D_{200}$. The collector (C) of the npn bipolar transistor $B_{200}$ are connected to the gate (G) of the transistor $M_{200}$ pulled high through the pull-up resistor. The transistor $M_{200}$'s source (S) is connected to the diode $D_{200}$'s anode, and the transistor $M_{200}$'s drain (D) is connected to the first diode $D_1$'s cathode.

Whenever the input voltage is higher than the energy storage capacitor voltage $V_{200}$, the first diode $D_1$ and second diode $D_2$ get reverse-biased and turned off, the diode $D_{200}$ gets forward-biased and turned on, the first energy storage capacitor $C_1$ and the second energy storage capacitor $C_2$ are charged in series with a first preset constant current programmed as a function of $I_{chg}=V_{BE}/R_2N$, wherein the base-emitter voltage $V_{BE}$ stands for the cut-in voltage of the npn bipolar transistor $B_{200}$.

Whenever the input voltage is lower than the capacitor voltage $V_{200}$, the first diode $D_1$ and second diode $D_2$ get forward-biased and turned on, the diode $D_{200}$ gets reverse-biased and turned off, the first energy storage capacitor $C_1$ and the second energy storage capacitor $C_2$ are discharged in parallel with a second preset constant current programmed as a function of $I_{dischg}=V_{BE}/R_d$, wherein $R_d$ stands for the resistance of the detecting resistor used to sense the current flowing through the lowest LED array segment ($G_{n+1}$).

From the foregoing paragraphs it can be seen proper selection of the resistor $R_{200}$ is highly associated with the proper settings of the charging current and the energy storage capacitor voltage. In particular, the purpose of the valley filler 200 is to provide the lowest LED array segment ($G_{n+1}$) with a second preset constant current only during the dead time. Therefore, the energy storage capacitor voltage is normally set to be $V_{Gn+1}<V_{200}<V_{Gn+1}+V_{Gn}$, already able to overcome the forward voltage drop of the lowest LED array segment ($G_{n+1}$) but still unable to overcome the total forward voltage drop of the lowest and the second lowest LED array segments ($G_{n+1}+G_n$). However, it would be better to set the energy storage capacitor voltage to be a little higher than but very close to the lowest LED array segment's forward voltage drop simply because the dead time in the line current waveform will be prolonged as a consequence of the increase in the energy storage capacitor voltage.

Figure 6B:
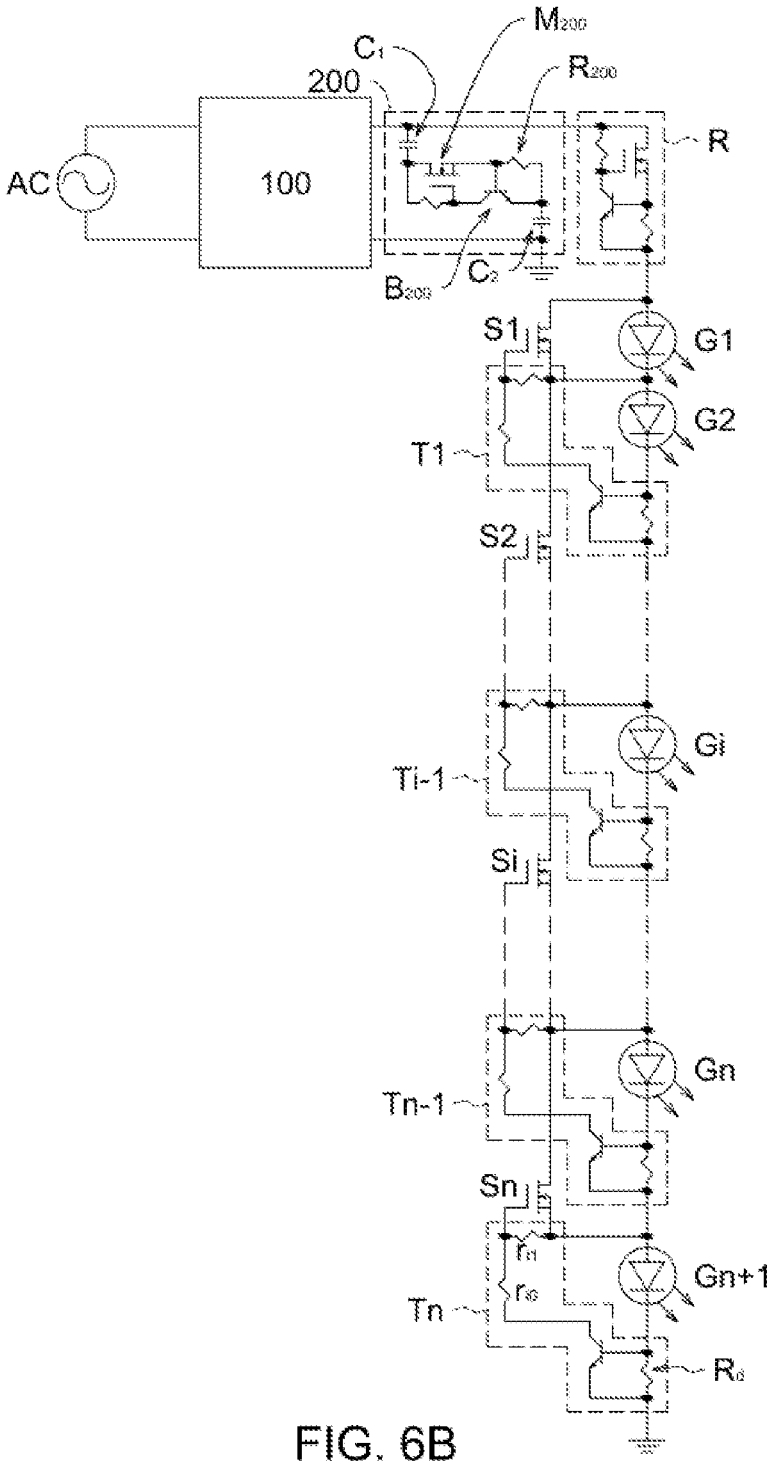
FIG. 6B unveils the LED lighting equipment with an optional, simplified double-capacitor valley filler according to the embodiment of the invention, wherein the simplified double-capacitor valley filler, resulting from eliminating the three diodes shown in FIG. 6A, has a different feature: the two energy storage capacitors get charged in series in the time of a higher input voltage and discharged in series in the time of a lower input voltage.
Figure 6C:
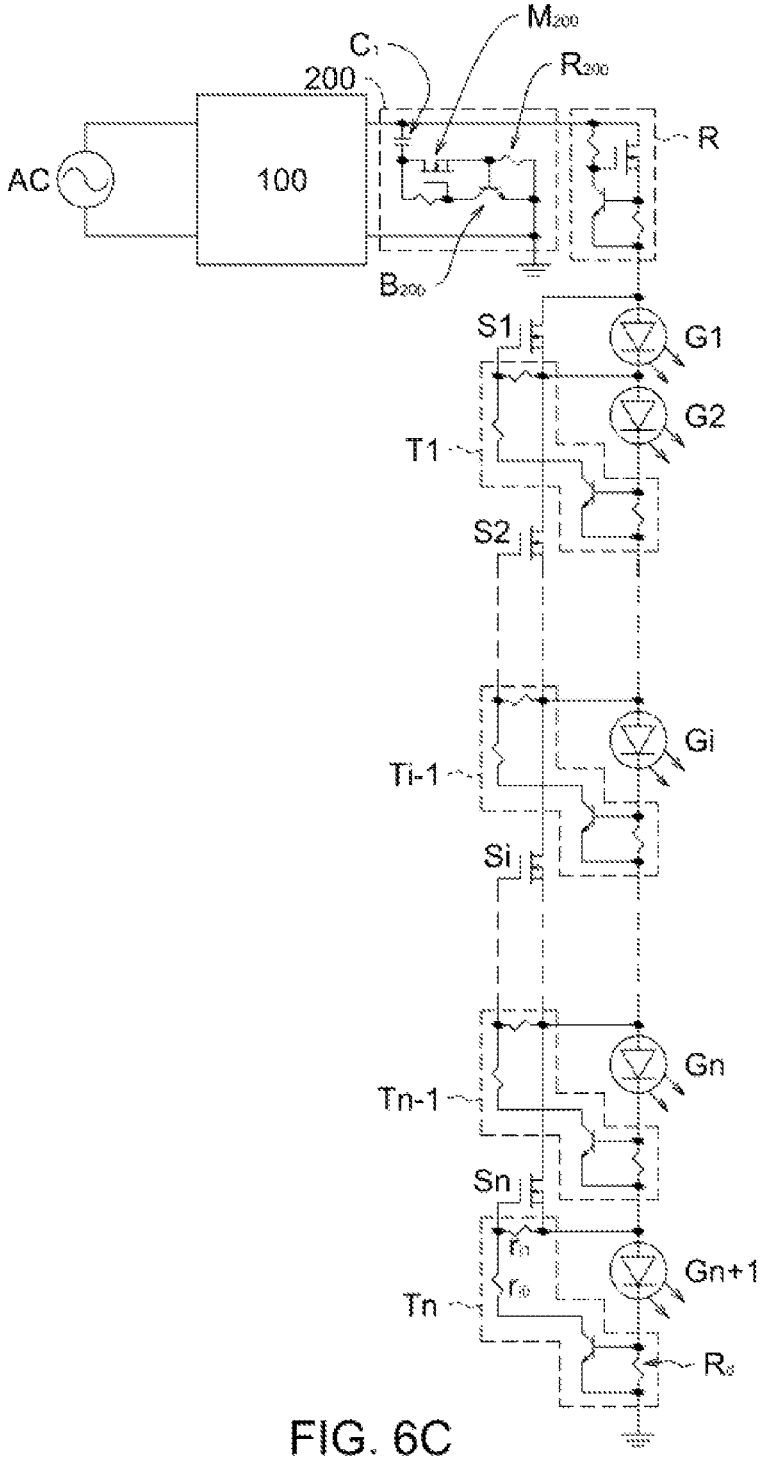
FIGS. 6C and 6D unveil two LED lighting equipments with two optional, further simplified single-capacitor valley fillers according to the embodiment of the invention, wherein the two further simplified single-capacitor valley fillers result from eliminating either of the two energy storage capacitors shown in FIG. 6B to form up two single-capacitor valley fillers.
Figure 6D:
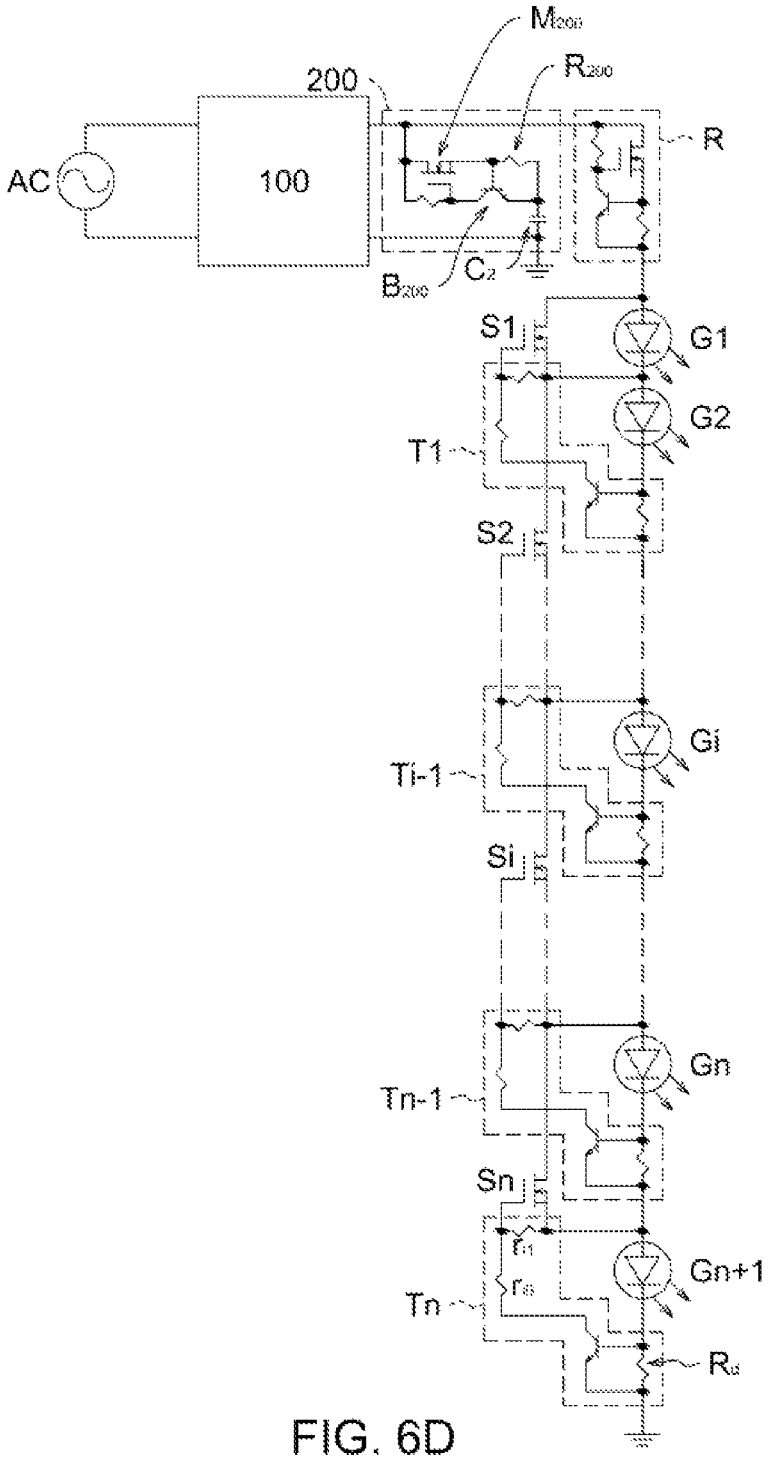

FIG. 6B shows a simplified embodiment derived from FIG. 6A by removing the first diode $D_1$, the second diode $D_2$, and the diode $D_{200}$ for the first energy storage capacitor $C_1$ and the second energy storage capacitor $C_2$ always to get charged or discharged in series. FIG. 6C and FIG. 6D show two further simplified embodiments derived from FIG. 6B by eliminating the first energy storage capacitor $C_1$ or the second energy storage capacitor $C_2$. FIG. 6C merely retains the first energy storage capacitor $C_1$, while FIG. 6D merely retains the second energy storage capacitor $C_2$.

Figure 7A:
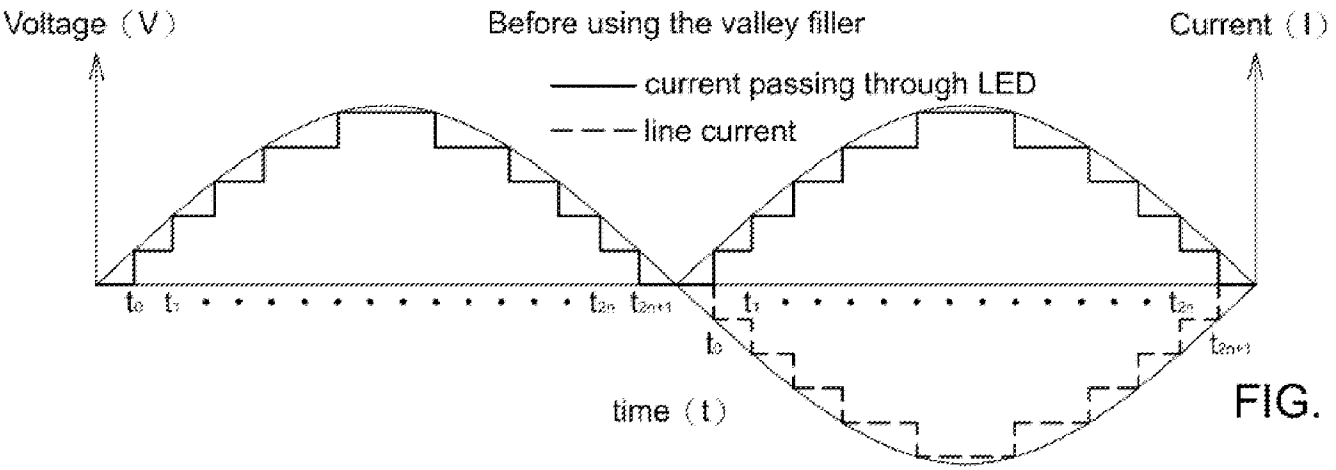
FIGS. 7A and 7B shed light upon the effect of the valley filler on the LED current waveform.
Figure 7B:
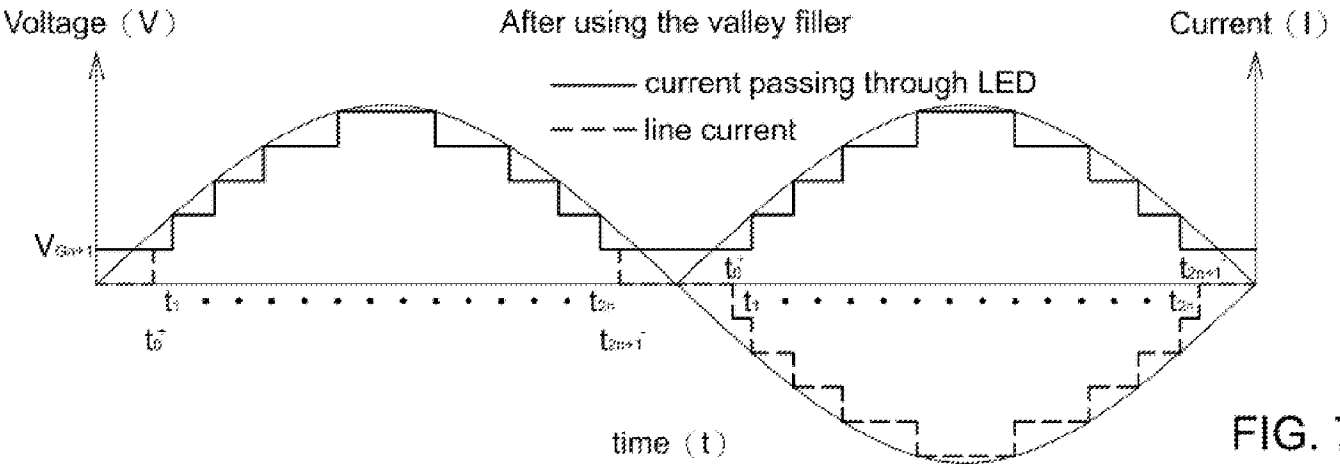

FIGS. 7A and 7B shed light upon the effect of the valley filler on the LED current (drawn with a solid line for identification) and the line current (drawn with a dashed line for identification) waveforms. FIG. 7A illustrates the consistency between the LED current and the line current before the adoption of a valley filler. That is to say, both the LED current and the line current remain zero during the dead time with an indication of the flicker phenomenon. FIG. 7B illustrates the difference between the LED current and the line current after the adoption of a valley filler. The LED current valleys get filled up with a second preset constant current only during the dead time to improve the flicker phenomenon while the line current still stays zero because the reverse-biased rectifier blocks the road when the capacitor voltage is higher than the input voltage. The dead time in the line current waveform also slightly increases because it takes a little longer time for the input voltage to get over the capacitor voltage charged up to a voltage level a little higher than the forward voltage drop of the lowest LED array segment.

In order to decrease the total harmonic distortion caused by the line current's dead time, the inventors also devised a dummy load. The dummy load provided by the invention embodiment comprises a controlled switch and a resistive load. The controlled switch electrically couples the resistive load to the two DC output terminals of the rectifier only within the dead time and then casts aside the resistive load. The resistive load consumes a line current only during the dead time to decrease the total harmonic distortion by eliminating the discontinuous or jumping points.

Figure 8:
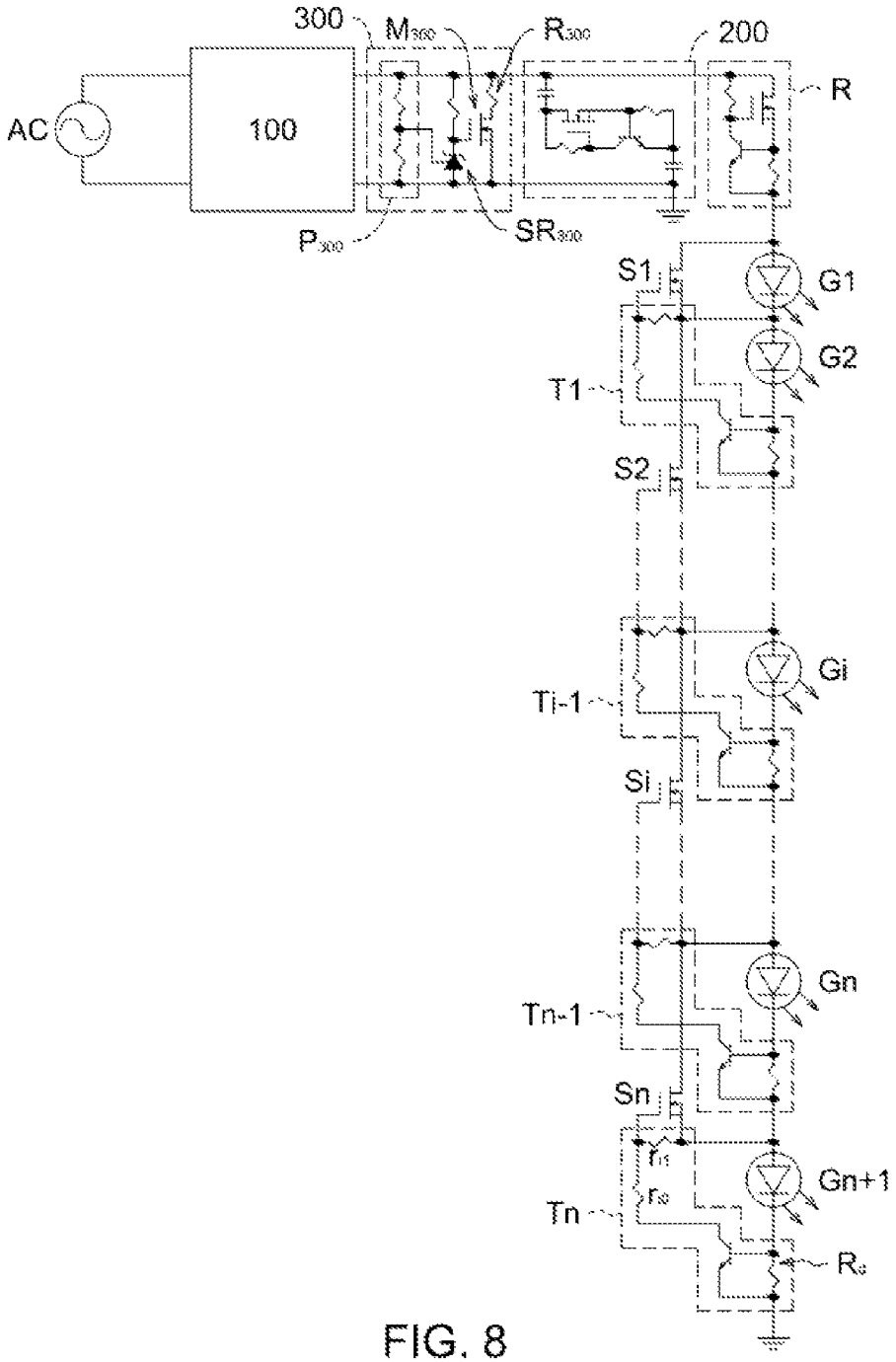
FIG. 8 illustrates the LED lighting equipment with an optional dummy load according to the embodiment of the invention, wherein the dummy load is connected to the two DC output terminals of the rectifier and in parallel with the LED light engine to further fix the issue with a high total harmonic distortion. The dummy load comprises a controlled switch and a resistive load. The controlled switch electrically connects the resistive load to the two DC output terminals of the rectifier only within the dead time, and then casts aside the resistive load. The resistive load draws a line current only during the dead time to decrease the total harmonic distortion by eliminating the discontinuous or jumping points. Therefore, the dummy load can effectively help decrease the total harmonic distortion with no significant loss of power efficiency due to resistive consumption.

FIG. 8 shows a dummy load 300, connected to the two DC output terminals of the rectifier 100 (such as a full-wave or half-wave rectifier) and in parallel with the LED light engine. The dummy load 300 comprises a voltage divider $P_{300}$, a shunt regulator $SR_{300}$, a controlled switch $M_{300}$, a resistive load $R_{300}$, and a pull-up resistor, wherein the reference terminal (R) and the anode (A) of the shunt regulator $SR_{300}$ are wired to the low side of a voltage divider $P_{300}$ across the rectifier 100's two DC output terminals, the cathode (K) of the shunt regulator $SR_{300}$ is connected to the gate (G) of the controlled switch $M_{300}$ pulled high through the pull-up resistor, the controlled switch $M_{300}$'s source (S) is connected to the shunt regulator $SR_{300}$'s anode (A), and the controlled switch $M_{300}$'s drain (D) is connected to the resistive load $R_{300}$.

Whenever the rectified sinusoidal input voltage is lower than the valley-filling capacitor voltage, the gate (G) of the controlled switch $M_{300}$ is pulled high because the shunt regulator $SR_{300}$'s cathode-anode channel is off as a result of a below-reference voltage applied to its reference terminal (R) and anode (A) ($V_{RA}<V_{REF}$), and thus the controlled switch $M_{300}$ is turned on to connect the resistive load $R_{300}$ to the two DC output terminals of the rectifier 100 during this period. Whenever the rectified sinusoidal input voltage is higher than the valley-filling capacitor voltage, the gate (G) of the controlled switch $M_{300}$ is pulled low because the shunt regulator $SR_{300}$'s cathode-anode channel is on as a result of an at-reference voltage applied to its reference terminal (R) and anode (A) ($V_{RA}=V_{REF}$), and thus the controlled switch $M_{300}$ is turned off to disconnect the resistive load $R_{300}$ from the two DC output terminals of the rectifier 100 during this period.

Connecting or disconnecting the resistive load $R_{300}$ could be simply achieved by turning on or off the controlled switch $M_{300}$ in response to the comparison between the voltage-sense signal and a reference voltage. There is no doubt other types of comparators can also be used.

Figure 9A:
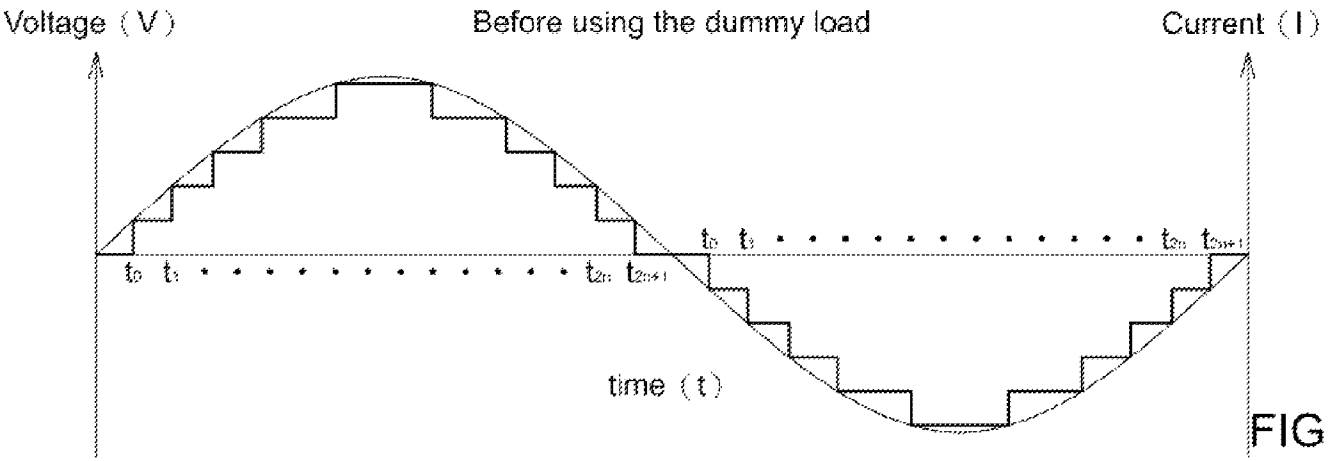
FIGS. 9A and 9B shed light upon the effect of the dummy load on the line current waveform.
Figure 9B:
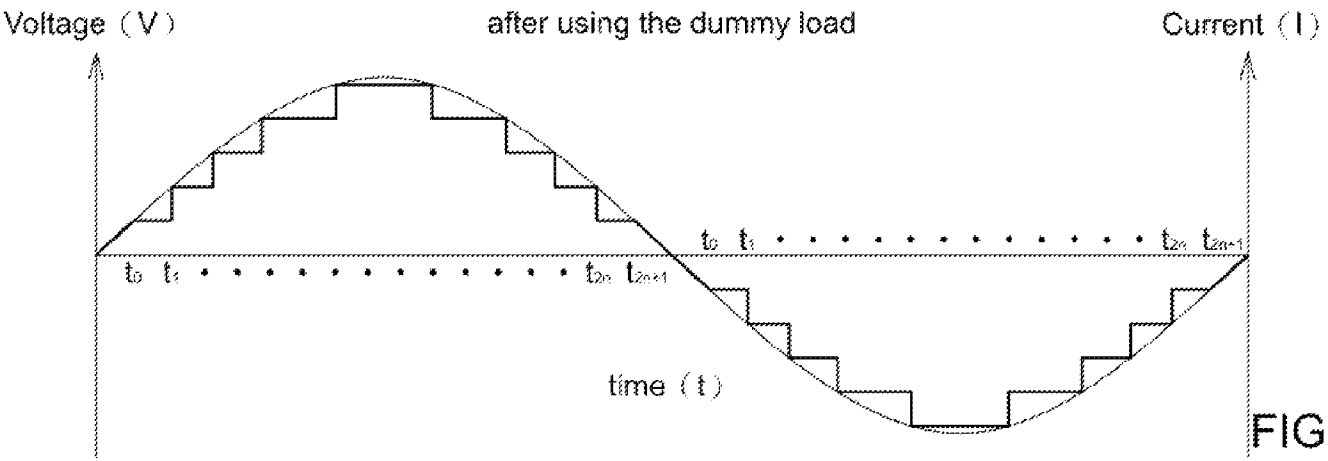

FIGS. 9A and 9B shed light upon the effect of the dummy load 300 on the line current waveform. FIG. 9A illustrates discontinuous or jumping points due to a dead time before the adoption of a dummy load 300 while FIG. 9B illustrates no discontinuous or jumping points due to no dead time after the adoption of a dummy load 300. The total harmonic distortion can be effectively decreased by eliminating discontinuous or jumping points from the line current with the use of a dummy load 300, drawing a line current only within the dead time.

In general, electronic control gears for LED light engine according to the embodiment of the invention can be integrated onto an integrated circuit, or separated into different modules.

For example, a rectifier, a current regulator, a string of bypass switches, a valley filler, and a dummy load can be integrated onto an integrated circuit.

Also, the rectifier, the current regulator and a string of bypass switches can be integrated onto an integrated circuit, and the valley filler as well as the dummy load are formed on another integrated circuit, and then integrated on a circuit board.

A plurality of external LED array segments are connected to the electronic control gears for LED light engine, the valley filler and the dummy load to form up the LED lighting equipment.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic control gear for LED light engine comprising:

a rectifier for connecting to an external AC voltage source;

a current regulator connecting to the rectifier; and a switch regulator chain having a plurality of switch regulators, the switch regulator chain connected in series with the current regulator and connected in parallel with an external LED array chain, the external LED array chain having a plurality of LED array segments, each of the switch regulators connected in parallel with a corresponding LED array segment except for a last segment in the external LED array chain, each of the switch regulators comprising a bypass switch and a detector, each of the detectors having a first terminal, a second terminal, and a third terminal, any two of the first terminals, the second terminals, and the third terminals connected to different nodes, a present detector receiving a voltage sense signal or a current sense signal, and a present bypass switch regulates LED current flowing through a downstream LED array segment at a preset constant current level, wherein each of the bypass switches is a normally closed electronic switch, a channel of each bypass switch is normally closed when the control voltage is absent or zero, channels of any adjacent two among the bypass switches are directly connected to each other, wherein when an input voltage is insufficient to forward-bias the downstream LED array segment, the present bypass switch remains in on state so that a channel of the present bypass switch shorts out the present LED array segment;

when the input voltage is high enough to forward-bias the downstream LED array segment but fails to forward-bias the present LED array segment, the present bypass switch regulates LED current flowing through the downstream LED array segment at a preset constant current level; and when the input voltage is high enough to forward-bias the present LED array segment, the present bypass switch is shut off to free up the present LED array segment.

2. The electronic control gear for LED light engine according to claim 1, wherein the bypass switch is an n-channel depletion-mode metal-oxide-semiconductor field-effect transistor (MOSFET) or an n-channel depletion-mode junction gate field-effect transistor (JFET).

3. The electronic control gear for LED light engine according to claim 1, wherein the detector is a current detector, a voltage detector, an optical detector, a magnetic detector or a comparator.

4. The electronic control gear for LED light engine according to claim 1, wherein the detector is a voltage detector, and the voltage detector comprises a voltage divider connected to two terminals across at least one LED in the downstream LED array segment, a partial or full forward voltage drop of the at least one LED sensed by the voltage divider is provided to the present bypass switch as a driving voltage.

5. The electronic control gear for LED light engine according to claim 1, wherein the detector is a current detector comprising a voltage divider, an npn bipolar junction transistor (npn BJT) and a detecting resistor, the detecting resistor is wired to a cathode of the downstream LED array segment, a base and an emitter of the npn BJT are wired to two terminals of the detecting resistor, the voltage divider is connected between an anode of the downstream LED array segment and a collector of the npn BJT, the partial voltage resulting from the voltage divider is provided to the present bypass switch as a driving voltage.

6. The electronic control gear for LED light engine according to claim 1, wherein the detector is a current detector comprising a voltage divider, a shunt regulator and a detecting resistor, the detecting resistor is wired to a cathode of the downstream LED array segment, an anode and a reference terminal of the shunt regulator are wired to two terminals of the detecting resistor, the voltage divider is connected between an anode of the downstream LED array segment and a cathode of the shunt regulator, a partial voltage resulting from the voltage divider is provided to the present bypass switch as a driving voltage.

7. The electronic control gear for LED light engine according to claim 1, wherein the current regulator comprises a MOSFET and an npn BJT, and the npn BJT is used for controlling the MOSFET to switch on or off.

8. The electronic control gear for LED light engine according to claim 1, wherein the current regulator comprises a MOSFET and a shunt regulator, the shunt regulator is used for controlling the MOSFET to switch on or off.

9. The electronic control gear for LED light engine according to claim 1, further comprising a valley filler connected to the rectifier, wherein the valley filler fills up valleys of an LED current waveform during a dead time, the valley filler comprises a first diode, a second diode, a first energy storage capacitor, a second energy storage capacitor, and a programmable constant current source, the programmable constant current source comprises a transistor, a third diode, a first resistor, an npn BJT and a second resistor, wherein the programmable constant current source is connected between the first energy storage capacitor and the second energy storage capacitor, when the input voltage is higher than a first energy storage capacitor voltage and a second energy storage capacitor voltage, the first energy storage capacitor and the second energy storage capacitor are charged in series with a first preset constant current, when the input voltage is lower than the first energy storage capacitor voltage and the second energy storage capacitor voltage, the first energy storage capacitor and the second energy storage capacitor are discharged in parallel with a second preset constant current.

10. The electronic control gear for LED light engine according to claim 1, further comprising a valley filler connected to the rectifier, wherein the valley filler fills up valleys of an LED current waveform during a dead time, the valley filler comprises a first energy storage capacitor, a second energy storage capacitor, a first diode, and a programmable constant current source, the programmable constant current source comprises a transistor, a first resistor, an npn BJT, and a second resistor, the programmable constant current source is connected between the first energy storage capacitor and the second energy storage capacitor, when the input voltage is higher than a first energy storage capacitor voltage and a second energy storage capacitor voltage, the first energy storage capacitor and the second energy storage capacitor are charged in series with a first preset constant current, when the input voltage is lower than the first energy storage capacitor voltage and the second energy storage capacitor voltage, the first energy storage capacitor and the second energy storage capacitor are discharged in series with a second preset constant current.

11. The electronic control gear for LED light engine according to claim 1, further comprising a valley filler connected to the rectifier, wherein the valley filler fills up valleys of an LED current waveform during a dead time, the valley filler comprises an energy storage capacitor and a programmable constant current source connected to the energy storage capacitor, the programmable constant current source comprises a transistor, a first resistor, an npn BJT and a second resistor.

12. The electronic control gear for LED light engine according to claim 1, further comprising a dummy load connected between a positive DC output terminal and a negative DC output terminal of the rectifier, wherein the dummy load comprises:

a voltage divider;

a shunt regulator, connected to the voltage divider;

a controlled switch, connected to the shunt regulator;

a resistive load, connected to the controlled switch; and a pull-up resistor, connected to the controlled switch.

13. The electronic control gear for LED light engine according to claim 1, wherein the electronic control gear for LED light engine is integrated into an integrated circuit, or the electronic control gear for LED light engine is separated into a plurality of modules to be laid out on a circuit board.

14. An LED lighting equipment, comprising:

the electronic control gear for LED light engine according to claim 1; and an LED array chain, wherein the LED array chain is connected in parallel with the electronic control gear for LED light engine.

15. An integrated circuit of an electronic control gear for LED light engine, comprising:

a rectifier used for connecting an external AC power source;

a current regulator connecting to the rectifier; and a switch regulator chain having a plurality of switch regulators connected in series, the switch regulator chain connected in series with the current regulator and in parallel with an external LED array chain, the external LED array chain having a plurality of LED array segments connected in series, each of the switch regulators is connected in parallel with a corresponding one of the LED array segments except for a last segment in the external LED array chain, each of the switch regulators having a bypass switch and a detector, each of the detectors having a first terminal, a second terminal, and a third terminal, any two of the first terminals, the second terminals, and the third terminals connected to different nodes, the detector detecting a downstream LED array segment to switch a present bypass switch, and the bypass switches being normally closed electronic switches, the bypass switches being normally closed when the control voltage being absent or zero, channels of any adjacent two among the bypass switches are directly connected to each other, wherein when an input voltage is insufficient to forward-bias the downstream LED array segment, the present bypass switch remains in on state so that a channel of the present bypass switch shorts out the present LED array segment;

when the input voltage is high enough to forward-bias the downstream LED array segment but fails to forward-bias the present LED array segment, the present bypass switch regulates LED current flowing through the downstream LED array segment at a preset constant current level; and when the input voltage is high enough to forward-bias the present LED array segment, the present bypass switch is shut off to free up the present LED array segment.

16. The integrated circuit of an electronic control gear for LED light engine according to claim 15, further comprising a valley filler wired to the rectifier to fill up valleys of an LED current waveform during a dead time, wherein the valley filler comprises an energy storage capacitor and a programmable constant current source, wherein the programmable constant current source is electrically connected to the energy storage capacitor to control a charging current and a voltage of the energy storage capacitor.

17. The integrated circuit of an electronic control gear for LED light engine according to claim 15, further comprising a dummy load connected between a positive DC output terminal and a negative DC output terminal of the rectifier, wherein the dummy load comprises:

a resistive load; and a controlled switch connected in series with the resistive load, the resistive load draws a line current during a dead time, and the controlled switch cuts off the resistive load after or before the dead time.

18. An LED lighting equipment, comprising:

the integrated circuit of an electronic control gear for LED light engine according to claim 15; and an LED array chain, wherein the LED array chain is connected in parallel with the integrated circuit of the electronic control gear for LED light engine.

* * * * *